US006746183B1

(12) United States Patent
Sullivan

(10) Patent No.: US 6,746,183 B1
(45) Date of Patent: Jun. 8, 2004

(54) SHORING DEVICE WITH OUTER RATCHETING COLLAR

(76) Inventor: James G. Sullivan, 10013 Norwood St., Rosemont, IL (US) 60018

( * ) Notice: Subject to any disclaimer, the term of this patent is extended or adjusted under 35 U.S.C. 154(b) by 0 days.

(21) Appl. No.: 10/252,255

(22) Filed: Sep. 23, 2002

(51) Int. Cl.[7] ..... A47F 5/00; E04G 25/04

(52) U.S. Cl. ..... 405/272; 405/278; 405/282; 248/354.7; 254/93 R

(58) Field of Search ..... 405/272, 274, 405/276, 277, 278, 279, 282, 283, 288, 292, 294; 299/31; 248/354.1, 354.3, 354.7, 357; 254/93 R, 98, 89 R

(56) References Cited

U.S. PATENT DOCUMENTS

| | | | | | |
|---|---|---|---|---|---|
| 1,170,992 | A | * | 2/1916 | Purdy | 254/98 |
| 3,362,168 | A | * | 1/1968 | Dotlich | 254/93 R |
| 3,851,856 | A | * | 12/1974 | Berg | 405/282 |
| 3,870,268 | A | | 3/1975 | Larkin | |
| 3,870,278 | A | * | 3/1975 | Lee | 248/354.3 |
| 4,375,934 | A | * | 3/1983 | Elliott | 248/354.7 |
| 4,441,736 | A | * | 4/1984 | Shedden | 248/354.3 |
| 4,486,050 | A | * | 12/1984 | Snyder | 299/31 |
| 5,094,576 | A | * | 3/1992 | Fredelius | 410/151 |
| 5,199,824 | A | | 4/1993 | Smith et al. | |
| 5,310,290 | A | * | 5/1994 | Spencer | 405/283 |
| 5,590,863 | A | * | 1/1997 | Sasaki | 248/354.3 |
| 6,371,422 | B1 | * | 4/2002 | St. Martin et al. | 248/354.3 |
| 6,394,405 | B1 | * | 5/2002 | Roxton et al. | 248/354.1 |

FOREIGN PATENT DOCUMENTS

| | | | |
|---|---|---|---|
| EP | 161634 | * | 11/1985 |
| FR | 73.17365 | | 12/1974 |
| GB | 2231353 | * | 11/1990 |
| GB | 2259690 | * | 3/1993 |

OTHER PUBLICATIONS

Paratech®: Collapse Rescue, undated.
www.beercoastguard.org/stakes.jpg: Stakes & . . . , undated.
LGH Rigging Services: Ratchet Straps, undated.
ART Lite®: Vehicle Stabilization Kit, undated.
Airshore Rescue Tools: Stabilization; rescue; Support, undated.

* cited by examiner

*Primary Examiner*—Jong-Suk (James) Lee
(74) *Attorney, Agent, or Firm*—Adrienne B. Naumann, Esq.

(57) ABSTRACT

A shoring device comprises a piston and a cylinder. The piston is axially expanded by compressed gas, whereby the shoring device engages two opposing surfaces. An outer ratcheting collar and a concentrically enclosed inner ratcheting ring are mounted upon the cylinder end receiving the piston. This outer ratcheting collar mechanically and frictionally engages at least one of a plurality of serrations of the enclosed inner-ratcheting ring. The outer ratcheting collar and inner ratcheting ring firmly hold the piston, thus preventing inadvertent rotation and collapse of the piston during the shoring device application. There is also an internal circular air channel feature, which more quickly and evenly distributes compresses gas or air to the piston for lateral expansion thereof.

4 Claims, 5 Drawing Sheets

103e
103a
137a
139a
103c
105a
155e
111
104a
160a
4
155b
156e
164b
156a
164ff
101
129
10k
129
113
5
107
130c
6
103b
103f
137b
139b
141a
105b
129a
135b
136b
120b
138b
131a
141b
130b
104b
128d
128e
131
102
102k
102c
164gg
156
156d
155m
155c
155q
155a
155
155f
103d
160b
164c
135a
136a
138a
120a
107
107c
113
114
102
101
170
107h
107f
107g
107i
107a
169b
155
160b

SHORING DEVICE WITH OUTER RATCHETING COLLAR

BACKGROUND OF THE INVENTION

My invention relates to a shoring device comprising a piston, cylinder, and an outer ratcheting collar combined with an inner ratcheting ring. More particularly, this invention relates to a shoring device with a moveable outer ratcheting collar, and which collar interlocks within an inner ratcheting ring over the piston and cylinder. My new outer ratcheting collar insures that the partially enclosed piston.

In experimental trials, my pneumatic shoring device withstood pneumatic pressures within the cylinder of at least 300 psi (pounds per square inch) for a minimum of fifteen seconds. My new device is intended for, but not exclusively, public works and construction, rescue and other projects in which shoring is necessary.

As workers shore trenches, they must quickly install shoring to prevent collapse of the trench walls. If shoring is not installed, soil cohesion is lost and it becomes almost impossible to maintain a safe trench. The prior art as best depicted in expired U.S. Pat. No. 3,851,856(Berg) provided a shoring device with an inlet connecting to a pressure source for expanding the device tightly against trench walls. There is also a rotational outer ratcheting ring mounted on one cylinder end, which receives the piston.

This rotational outer ratcheting ring extends axially from the cylinder and surrounds a proximal piston end.

Still referring to the Berg device, the rotational member is prevented from rotation in part by a cam-like ridge along the proximal member edge. Subsequent to cylinder pressurization the piston remains extended by securing the cam-like ridge on the rotational member with an abutting cam pin. However the only structure in Berg's device which prevents the piston from random axial movement projectile is a small diameter pin. This small diameter pin penetrates the rotational member and abuts the cylinder, after the abutting cam pin is already in place. The small diameter pin end abuts the cylinder, and can be further tightened against the cylinder by a t-bolt.

The disadvantage of Berg is that this small diameter pin is the only opposing frictional and mechanical force which maintains the piston in an extended position after the gas pressure is removed. Also this pin's force is only perpendicular to the long axis of the piston and cylinder. In contrast, my new shoring device comprises an inner-ratcheting ring which, in combination with an outer ratcheting collar, maintains the piston in an extended position. This inner ratcheting ring preferably attaches to the cylinder with allen screws (threaded with hexagonal head depressions), as well as a circular metal lip which engages one cylinder end. The inner ratcheting ring reduces the likelihood that the piston becomes a projectile. This safety feature occurs because the piston abuts the inner lip, and so the piston cannot move laterally.

The outer removable ratcheting collar encloses the inner ratcheting ring and interlocks with inner ratcheting ring serrations. Outer ratcheting collar preferably comprises one rectangular protrusion which interlocks with the inner serrated ring. This interlocking prevents counter-clockwise rotation of the outer ratcheting collar thereby preventing collapse of the piston upon the sound or floor.

My improved shoring device is engineered to assist underground workers in compliance with the OSHA regulation governing excavations, i.e., 29 C.F.R. 1926.650. This group includes, but is not limited to, sewer contractors, plumbers, gas companies, telephone companies, municipal public works departments and fire rescue services. The principle goal of my shoring device is to provide the necessary physical support which ensures a work environment safe from collapse.

In particular, shoring is the placement of crossbracing and other components within a trench to support trench walls. There are two important theories of shoring: first is the theory of "zero-movement", in which shoring is designed to prevent wall movement. Shoring is not sufficiently strong to retain a moving wall of soil: it merely prevents a soil wall from initially moving. The second theory of shoring is designated the "Arch Effect." Shoring is effective because it creates forces as it pushes again trench walls. The network of crossbraces and uprights or wale-plates creates an arch effect which retains soil. The shoring and crossbracing actually retains soil, and not the plywood or sheeting.

An operator applies plywood or sheeting to prevent surface soil from falling and injuring a worker. To achieve "zero movement" and the "arch effect," all gaps and voids must be filled where the crossbrace bears on the trench wall. Other than the mandatory inspection for damage before each use and an occasional cleaning, there are no maintenance requirements.

My preferred pneumatic shoring device also comprises a contiguous series of pressurized gas channel through the cylinder of the piston. This contiguous pressurized gas channel includes a circular channel segment along the lower floor surface of a cylinder endcup.

SUMMARY OF THE INVENTION

My improved shoring device is much safer than, yet remains just as cost effective, as the prior art. The new crucial safety feature comprises an outer ratcheting collar in combination with an inner ratcheting ring, both of which concentrically enclose a cylinder which contains a piston. Any loosening of the piston through rotational counterclockwise movement requires the installer's deliberate act of manually depressing a thumblock. This thumblock disengages outer ratcheting collar from the inner ratcheting ring. In addition, an inner ratcheting ring greatly reduces the likelihood that the piston will become a projectile. This is because the rubber piston cup cannot move past the circular lip along the inner ratcheting ring.

The piston is cylindrical in shape and inserts within the larger diameter cylinder (which is also cylindrical in shape). The piston also comprises a plurality of aligned apertures, into which a metal camming pin inserts. This metal camming pin, in combination with a camming surface, prevents the piston from retracting into the cylinder, once the air pressure is removed. This metal camming pin provides initial adjustment whenever an operator rotates the outer ratcheting collar during installation of the shoring device. Fine adjustment subsequently occurs whenever the outer ratcheting collar interlocks with the enclosed inner-ratcheting ring.

Testing of my shoring device in the preferred pneumatic embodiment confirms that it is stronger than any conceivable soil load. See 29 C.F.R. 1926.652. In particular, the inner ratcheting ring comprises a plurality of serrations, and there is a corresponding locking protrusion within the outer ratcheting collar. The inner ratcheting ring encloses the proximal cylinder end, and this ring is further attached to the cylinder with at least two screws.

With my shoring device, engagement with an inner ratcheting ring occurs automatically upon clockwise rotation of outer ratcheting collar. In contrast, release of outer ratcheting collar requires the operator's depression of a thumblock. In contrast, the interlocked position of the outer ratcheting collar requires no act by the operator. The initial lateral extension of my assembled improved shoring device occurs whenever pressurized air enters the cylinder during a trench application. For support of a car an unstable or building, my shoring device is manually extended until resistance is felt, and then the outer ratcheting collar is locked.

During removal of an installed shoring device, there is counter-clockwise release of the outer ratcheting collar prior to removal of the air pressure. In actual field operations, air pressure is not removed from the shoring device until the operator has moved to a safe position removed from the device.

Each shoring device also comprises two removable swivel sideplates. One sideplate reversibly attaches to the most distal piston end, while the other similarly attaches to the most proximal cylinder end. My removable swivel sideplates comprise adjustable setscrews for engagement of wood shoring boards or aluminum wale-plates. Each preferred setscrew is approximately ¼ inch in diameter, and comprises twenty threads per inch. Each preferred setscrew is also approximately one inch in length. However, other sideplates or end adapters are also within the scope of my invention, and may be even preferably for primarily vertical or angled applications, such as buildings or vehicles.

My preferred pneumatic shoring device also comprises a cylinder plug. Cylinder plug is hollow at its proximal end to accommodate one removable swivel sideplate. The remaining approximate one-half of the cylinder plug is solid metal and comprises a continuous channel for compressed air. A novel feature of my modified cylinder plug is a cylinder rubber endcup at its distal plug end. Cylinder rubber endcup more efficiently prevents air leaks from the air channel segments within metal cylinder plug. In the preferred embodiment and best mode, the cylinder endcup comprises apertures and a circular channel, which contribute to the most efficient airflow from cylinder plug distal end. More preferably, this air channel segment lies along the lower floor surface of the cylindrical rubber endcup.

This circular channel segment comprises a contiguous aperture through which pressurized air from a gas inlet evenly and quickly seals the raised edge of a piston rubber endcup. In contrast, the prior art comprises a circular groove around the circumference of the metal cylinder plug, and into which groove a rubber O-ring is inserted. The problem with this prior art approach is breakage of the o-ring upon metal groove edges, and subsequence leakage of air from the cylinder plug.

My preferred improved shoring device is assembled by inserting the piston so that its piston rubber endcup initially abuts cylinder rubber endcup. The inner ratcheting ring is next inserted over the cylinder end until its circular metal lip engages the distal cylinder end. Inner ratcheting ring is then bolted to the cylinder. Outer ratcheting collar is next positioned so that it encloses inner ratcheting ring.

The outer ratcheting collar has limited movement along the cylinder, but it can be manually rotated and then locked to inner serrated ring. At least approximately one-third of the longitudinal axial length of the piston must always remain within the cylinder. After the outer ratcheting collar fits over the inner serrated ring, the operator finally inserts the removable swivel sideplates at the distal and proximal end of the shoring device.

My pneumatic shoring device for use in trenches is the preferred embodiment.

It is another goal of my invention to provide a more uniform distribution of pressurized air by providing a circular channel segment within the cylinder.

It is another goal of my invention to provide an anti-projectile feature to prevent the piston from ejecting from the cylinder.

It is another goal of my invention to provide cast aluminum handles for manual rotation of outer ratcheting collar.

These as well as other features of my device are described further in the drawings and the detailed description of the preferred embodiment and other embodiments

DETAILED DESCRIPTION OF THE PREFERRED EMBODIMENT AND OTHER EMBODIMENTS

Figure 2:
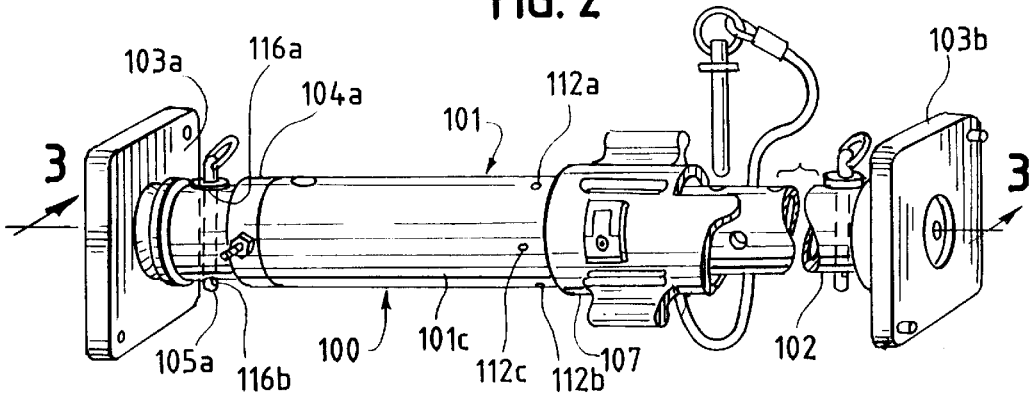
FIG. 2: Longitudinal prospective view of my improved shoring device with outer ratcheting collar.
Figures 3, 4, 5, 6:
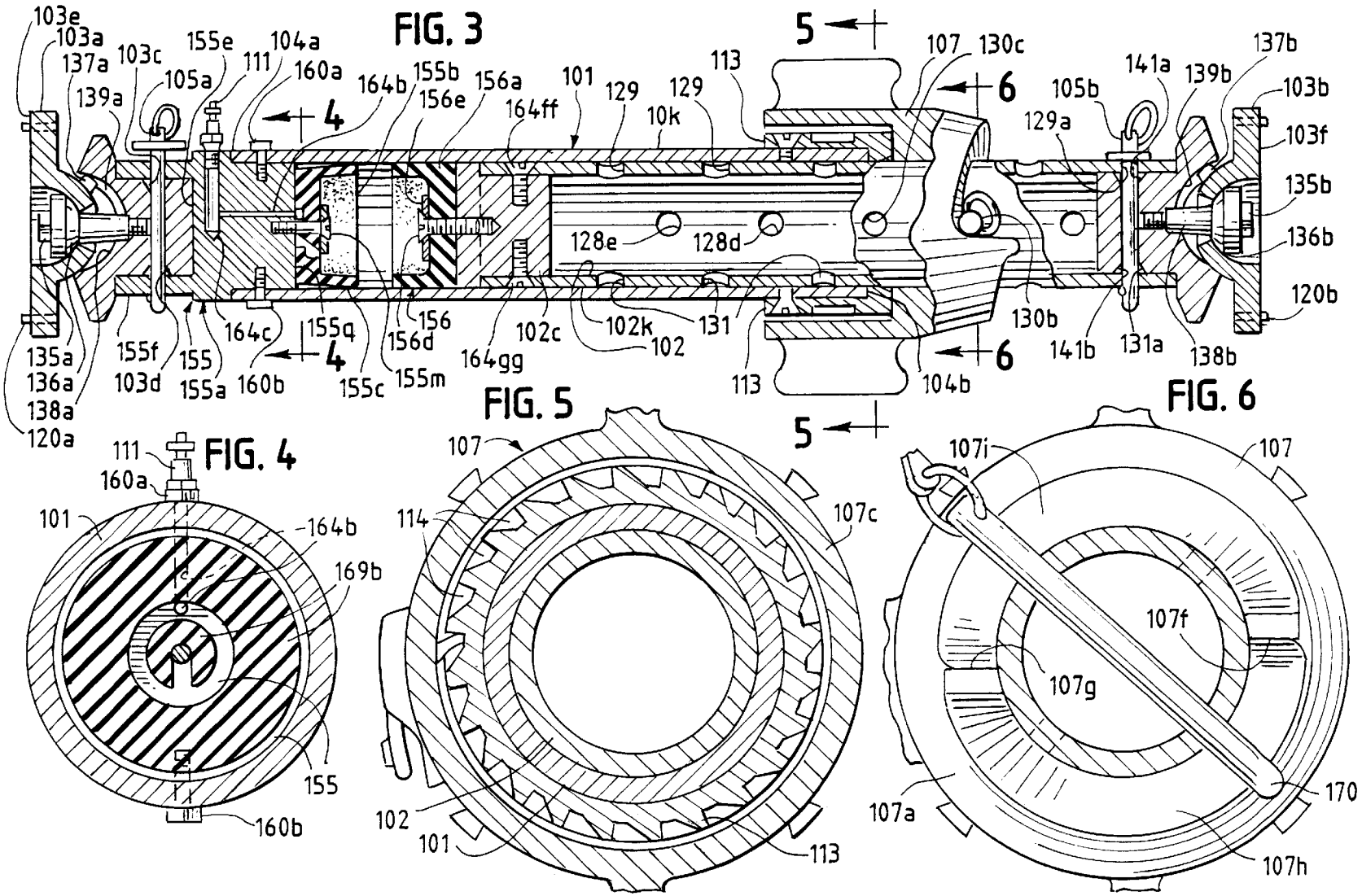
FIG. 3: Partial transverse longitudinal view of shoring device through view line 3—3.
FIG. 4: Cross-sectional view of FIG. 3 taken through view line 4—4.
FIG. 5: Cross-sectional view of FIG. 3 taken through view line 5—5.
FIG. 6: Cross-sectional view of FIG. 3 taken through view line 6—6.

Referring initially to FIGS. 2 and 3 of the preferred embodiment, my improved shoring device 100 comprises a piston 102, cylinder 101, an outer ratcheting collar 107, and an inner-ratcheting ring 113. Shoring device 100 is particularly suited for shoring of trench walls, by using compressed gas to laterally extend piston 102. However, other sources of appropriate lateral force are also within the scope of my invention. My shoring device 100 is preferably approximately 43 inches long in its maximum extended configuration, and approximately 33 inches in its most retracted configuration. Three other satisfactory lengths are as follows:

(1) approximately 25 inches when fully retracted and approximately 30 inches when fully extended;

(2) approximately 45 inches when fully retracted position and approximately 65 inches when fully extended; and (3) approximately 67 inches when fully retracted and approximately 102 inches when fully extended.

However, other diameters and lengths are also within the scope of my invention. Circular rubber endcups 155*b*, 156 infra, add approximately two inches to every model, so that only cylinder and piston length varies.

Cylinder 101 and Swivel Sideplates 103*a*, 103*b*

Still referring to FIGS. 2 and 3 of the preferred embodiment, my improved shoring device 100 comprises a cylinder 101. Cylinder 101 is preferably approximately 15 inches in length and approximately 3.0 inches in interior diameter. Cylinder wall 101*c* is preferably approximately one-quarter of an inch (¼") thick. Cylinder 101 has a proximal cylinder end 104*a* and distal cylinder end 104*b*.

Figure 1:
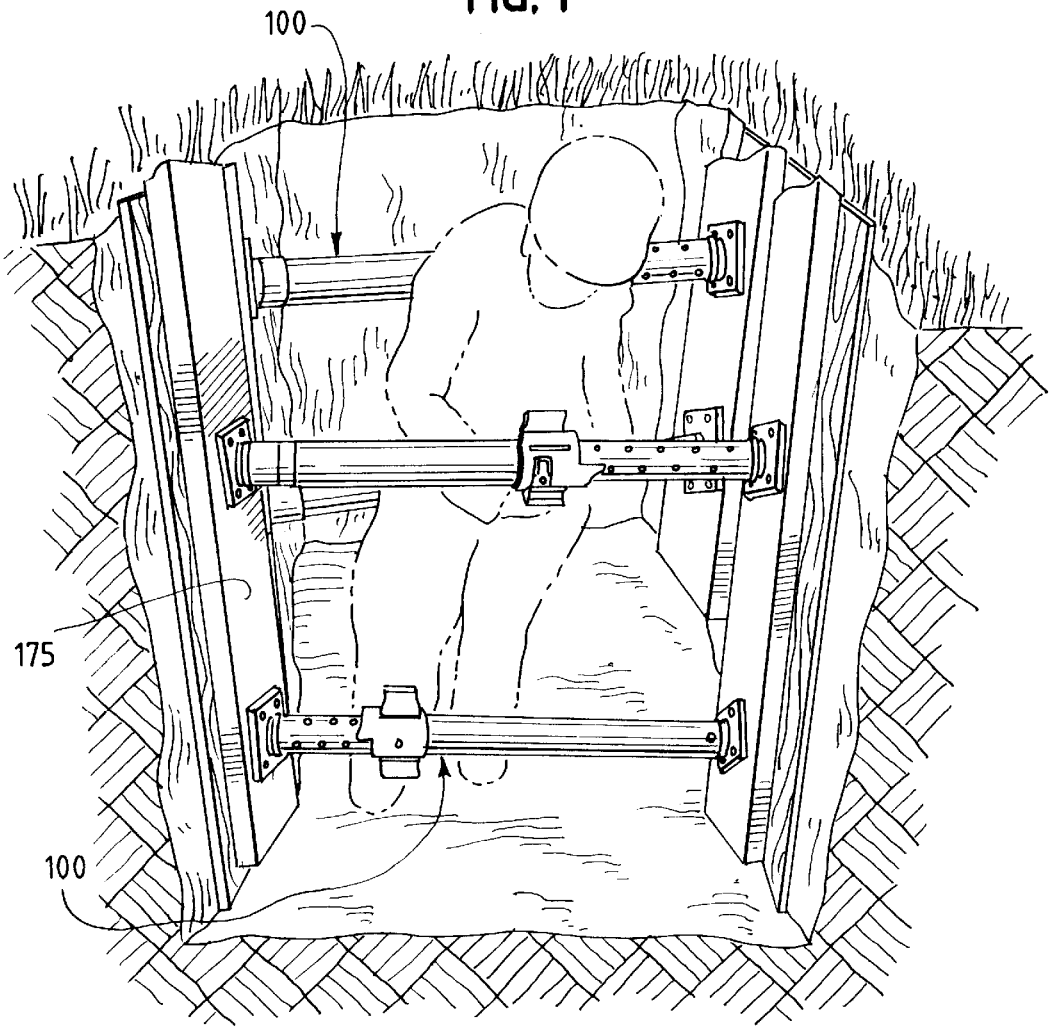
FIG. 1: Anterior view of operator installing a plurality of shoring devices within a trench.

Cylinder 101 also comprises a removable swivel proximal cylinder sideplate 103*a* whenever shoring device 100 is fully assembled. Swivel proximal cylinder sideplate 103*a* is identical in structure, size and function to removable swivel distal piston sideplate 103*b*, infra. Each swivel sideplate 103*a*, 103*b* comprises a plate 103*e*, 103*f* which is preferably approximately five inches in length and width. Each swivel sideplate 103*a*, 103*b* also comprises a central screw 135*a*, 135*b* respectively, and a central segment 136*a*, 136*b* respectively. Swivel proximal and distal sideplates 103*a*, 103*a* respectively also each comprise at least one adjustable first and second set screw 120*a*, 120*b* respectively, for engagement with wood shoring boards and/or aluminum waleplates 175 (FIG. 1).

Each central segment 136*a*, 136*b* respectively comprises a first and second swivel groove 137*a*, 137*b* respectively. First and second insertable portions 138*a*, 138*b* respectively attach within grooves 137*a*, 137*b* respectively, by their first and second insertable ridges 139*a*, 139*b* respectively.

Each groove 137*a*, 137*b* containing an insertable ridge 139*a*, 139*b* respectively prevents a swivel proximal or distal sideplate 103*a*, 103*b* respectively, from swiveling in an unlimited manner. Removable swivel sideplates are well known in this particular equipment industry. However, other sideplates, baseplates or attachments are also within the scope of my invention.

Still referring to FIGS. 2 and 3 of the preferred embodiment, at proximal cylinder end 104*a* is proximal sideplate detente pin 105*a*. Proximal sideplate detente pin 105*a* connects cylinder 101 to swivel cylinder proximal sideplate 103*a* by insertion through (i) first and second proximal sideplate swivel apertures 103*c*, 103*d* respectively and; (ii) congruently aligned first and second cylinder end apertures 116*a*, 116*b*.

First and second proximal sideplate swivel apertures 103*c*, 103*d* oppose each other at approximately 180 degrees. Cylinder end apertures 116*a*, 116*b* also oppose each other at approximately 180 degrees. Cylinder end apertures 116*a*, 116*b* can congruently align with swivel apertures 103*c*, 103*d* whenever swivel proximal cylinder sideplate 103*a* inserts into cylinder 101. Cylinder end apertures 116*a*, 116*b* are approximately one and ¾ inches from cylinder proximal end 104*a*.

Figures 7, 8:
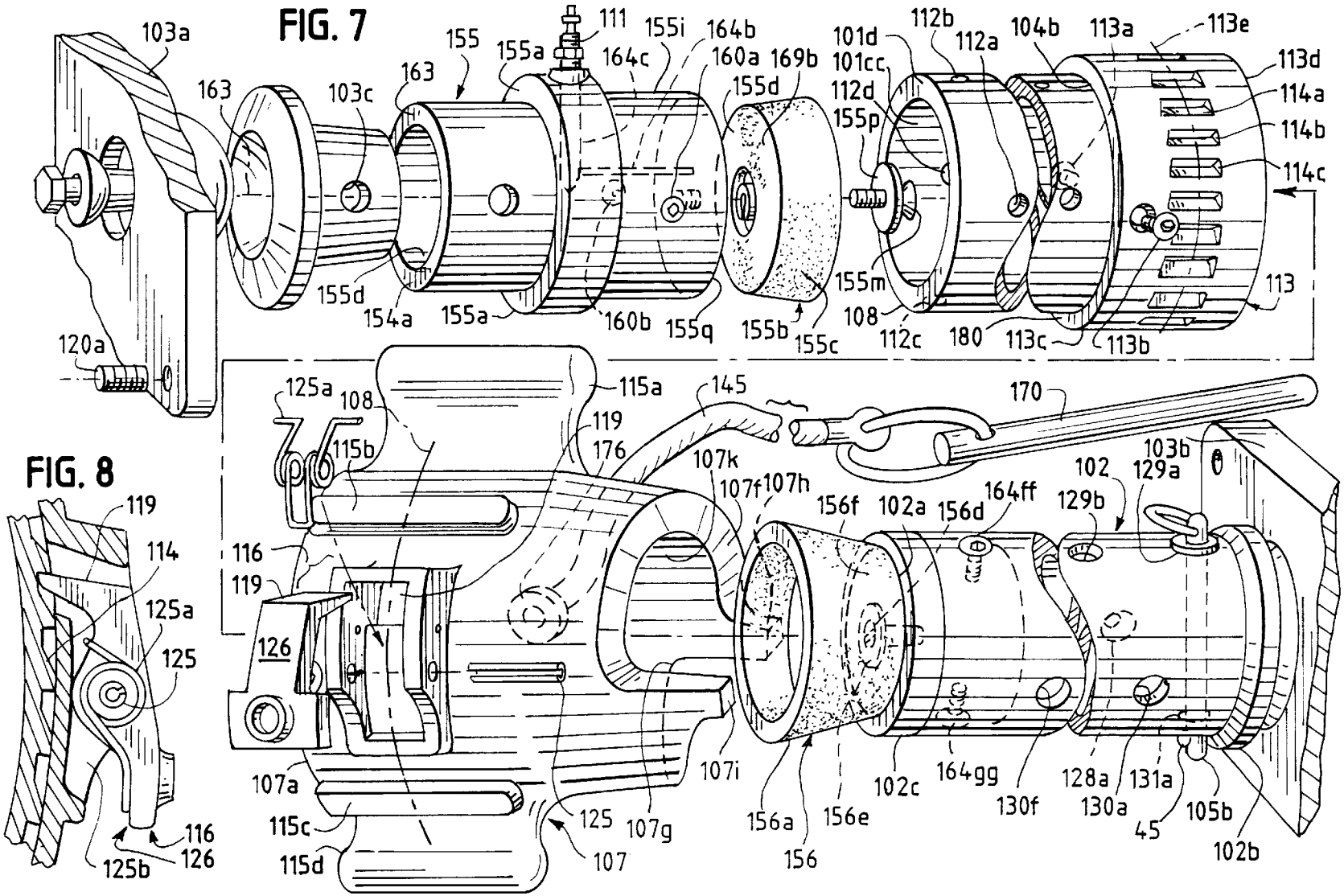
FIG. 7: Exploded view of shoring device.
FIG. 8: Lateral isolated view of locking member engaged within a serration.

Referring now to FIGS. 3 and 7 of the preferred embodiment, approximately three inches from inserted proximal sideplate 103*a*, and approximately 90 degrees from proximal detente pin 105*a*, is compressed gas inlet 111. Compressed gas inlet 111 connects shoring device 100 to an external source of compressed gas through cylindrical plug 155, infra.

As seen in FIGS. 2 and 7, small circular vents 112*a*, 112*b*, 112*c*, 112*d* (generically small circular vents 112) for gas exhaust are aligned along a cylinder circumference at intervals of approximately 90 degrees to each other. Small circular vents 112 are approximately one quarter inch in diameter. In the preferred embodiment there are four small circular vents 112, but other numbers are also satisfactory.

Proximal Cylinder Plug 155

Referring to FIGS. 3 and 7, cylinder plug 155 is part of cylinder 101, and cylinder plug 155 is contiguously attached to cylinder 101 by first and second set screws 160*a*, 160*b* respectively. First and second set screws 160*a*, 160*b* oppose each other at approximately 180 degrees along cylinder 101. Cylinder plug 155 abuts proximal cylinder end 104*a* by circular contiguous ledge 155*a*. Metal contiguous ledge 155*a* is also the cylindrical component into which compressed gas inlet 111 inserts. Cylinder swivels proximal sideplate 103*a* inserts into cylinder plug 155 proximal to circular contiguous ledge 155*a*.

Still referring to FIGS. 3 and 7, the inner diameter of cylinder plug 155 is approximately 3.5 inches. Cylinder plug wall 155*f* is preferably approximately ⅔ (two-thirds) inch in thickness at proximal plug end 154*a*. Cylinder plug interior 155*d* comprises a proximal round metal barrier 155*e* which abuts fully inserted swivel proximal cylinder sideplate 103*a*.

Still referring to FIGS. 3 and 7, cylinder plug 155 at distal plug end 155*q* comprises cylindrical endcup 155*b*. Cylindrical endcup 155*b* comprises an outer raised circular rim 155*c*, which faces a piston rubber endcup 156, infra, within a fully assembled shoring device 100. Cylindrical endcup 155*b* comprises the same shape, dimensions and material as piston rubber endcup 156, infra. Cylindrical endcup 155*b* abuts piston rubber endcup 156 by raised circular rim 155*c*, whenever piston 102 is completely inserted within cylinder 101. Cylindrical endcup 155*b* also comprises a cylindrical endcup floor 155*d* with centrally located bolt aperture 155*j*. Plug bolt 155*m* inserts into bolt aperture 155*j* and thereby attaches distal plug end 155*q* to cylinder endcup 155*b*. Cylinder washer 155*p* surrounds plug bolt 155*m*

Figure 9:
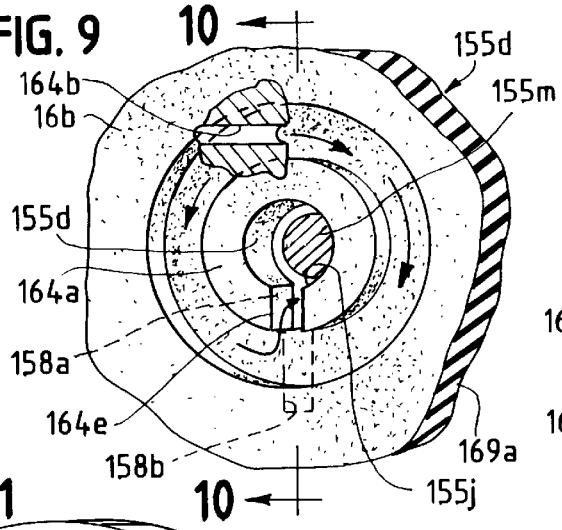
FIG. 9: Isolated view of lower floor surface of cylinder endcup.

Initially referring to FIG. 9, cylindrical endcup floor 155*d* comprises an upper endcup floor surface 169*a* and a lower endcup floor surface 169*b*. Also referring to FIG. 10 of the preferred embodiment, cylinder endcup 155*b* comprises a lower air aperture 158*b* within its lower endcup floor surface 169*b*, and upper air aperture 158*a* within upper endcup floor surface 169*a*. Lower and upper air apertures 158*a*, 158*b* respectively are integrally connected to each other by (i) a fist air channel segment 164*a* within rubber endcup floor surface 169*b*; and (ii) a short air channel segment 164*e* traversing rubber cylinder endcup floor 155*d*.

Figure 10:
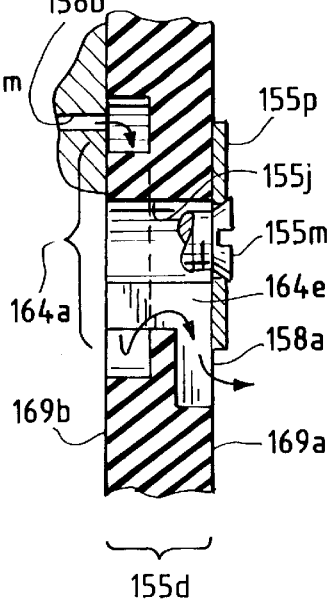
FIG. 10: Closeup cross-sectional view of FIG. 9 taken through view line 10—10.

As best seen in FIGS. 4 and 9, first air channel segment 164*a* is circular, approximately one inch in exterior diameter and approximately one-quarter inch in depth along lower cylindrical endcup floor surface 169*b*. As best seen in FIG. 10, short air channel segment 164*e* is adjacent and parallel to bolt aperture 155*j* within endcup floor 155*d*. Short air channel 164*e* connects circular air channel segment 164*a* to upper aperture 158*a*. However, other embodiments of my invention need not comprise a first air channel segment 164*a* which is circular.

Referring to FIGS. 3 and 7, lower air aperture 158*a* is congruent and contiguous with second air channel segment 164*b* within cylinder plug 155. Air channel segment 164*b* is adjacent to and parallel to longitudinal midline 163 of cylindrical plug 155, as seen in FIG. 4. In the preferred embodiment, second air channel segment 164*b* is continuously connected to third air channel segment 164*c*. Third air channel segment 164*c* is approximately perpendicular to second air channel segment 164*b*. Preferably both air channel segments 164*b* and 164*c* are linear in form.

Second air channel segment 164*b* leads towards the outer metal surface of cylinder plug 155, and is continuous with gas inlet 111. Gas inlet 111 is continuously connected to an external source of pressurized gas, such as CO2 or air. Consequently when air is introduced from an exterior source, there is a continuous pressurized gas channel through: gas inlet 111; third and second air channel segments 164*c*, 164*b*; lower air aperture 158*b*; circular first air channel segment 164*a*, short air channel segment 164*e*; and finally upper air aperture 158*a*.

After passing through this previously described pathway, within seconds this pressurized air seals piston endcup raised circular rim 156*a* against inner cylinder wall 101*cc*. FIG. 4 illustrates the physical continuity of lower aperture 158*a* in rubber endcup 155*b*, with metal distal cylindrical plug end 155*q*, with respect to bolt aperture 155*j* and adjacent second air channel segment 164*b*.

Piston 102

Referring initially to FIGS. 2 and 3 of the preferred embodiment, piston 102 is cylindrical, approximately thirteen (13) inches in length, and approximately two and one-quarter inches in inner diameter. However, other lengths and diameters are also within the scope of my invention. Piston 102 comprises a piston wall 102*k*, which is approximately ¼-inch (one-quarter) inch in thickness. Piston 102 is narrower in diameter than cylinder 101, into which piston 102 removeably inserts.

Along its longitudinal axis piston 102 comprises four linearly aligned parallel sets of piston apertures 128*a*, 128*b*, 128*c*, 128*d*; 128*e*; 129*a*, 129*b*, 129*c*, 129*d*, 129*e*, 129*f*; 130*a*, 130*b*, 130*c*, 130*d*, 130*e*; and 131*a*, 131*b*, 131*c*, 131*d*, 131*e*, 131*f* (generically opposing piston apertures 128, 129, 130, 131). Representative apertures 128, 129, 130, 131 are best seen in FIGS. 3 and 7, and are preferably approximately 1 and ½ inches in diameter.

Each set of piston apertures 128, 129, 130, 131 is preferably approximately 90 degrees from each adjacent aligned set. However, individual adjacent apertures are preferably aligned at the midpoint of adjacent apertures, as best seen in FIG. 3. Opposing sets 128/130 and 129/131 are approximately 180 degrees from each other, so that straight metal camming pin 170 is inserted through them simultaneously, as best seen in FIG. 7. Four linearly aligned sets are preferred, but other numbers of linearly aligned sets are also within the scope of my invention. There are also preferably two opposing sets of five apertures per linearly aligned set (128, 130), and two opposing sets of six apertures (129, 131) per linearly aligned set. However, other numbers of piston apertures are also within the scope of my invention.

Still referring to FIGS. 3 and 7, in a fully assembled shoring device 100, piston 102 is closed at most distal end 102*b* by swivel piston distal sideplate 103*b*. Swivel piston distal sideplate 103*b* is attached within piston 102 by insertion of piston detente pin 105*b* within:

(i) piston apertures 128/130 or 129/131 and (ii) first and second swivel sideplate apertures 141*a*, 141*b* respectively. Piston apertures 128/130 or 129/131 and sideplate apertures 141*a*, 141*b* must be congruently aligned with each for insertion of piston detente pin 105*b*.

Still referring to FIGS. 3 and 7, at its proximal end 102*a* piston 102 is capped by metal piston endwall 102*c*. Metal piston endwall 102*c* is secured to piston 102 by first and second opposing screws 164*ff*, 164*gg* respectively. Metal piston endwall 102*c* is flush with piston wall 102*k*, and is approximately one-half inch in thickness at its proximal end.

A piston rubber endcup 156 is secured to metal piston endwall 102*c* by piston bolt 156*d* extending through metal washer 156*e*. In the center of piston rubber endcup flat circular floor 156*f* (which is preferably approximately three inches in diameter) is piston bolt 156*d*. In other embodiments, piston endcup 156 comprises identical apertures 158 and channel segments 164 to cylinder endcup 155*b*. In fact if endcups 155*b*, 156 are mass produced, this would be the most economical approach. However, in these embodiments apertures and channels in endcup 156 are covered with a large washer because they have no function in piston endcup 156. In the preferred embodiment, piston endcup 156 comprises no air apertures or air channel segments of any type. Please see FIGS. 3 and 7.

Circular piston rubber endcup 156 comprises raised circular rim 156*a*, and raised circular rim 156*a* is preferably approximately one inch in height. Circular piston rubber endcup 156 immediately flares, and thereby airseals circular raised rim 156*a* whenever compressed gas enters inlet 111 and flows through air channel segments 164 and air apertures 158*a*, 159*b*. This airseal is caused by compression of raised circular rim 156*a* against interior cylindrical wall surface 101*cc* by pressurized gas.

Inner Ratcheting Ring 113

Referring initially to FIGS. 5 and 7 of the preferred embodiment, inner ratcheting ring 113 encloses distal cylinder end 104*b* in my fully assembled shoring device 100. Inner ratcheting ring 113 attaches to cylinder 101 by first serration set screw 113*a* and second serration set screw 113*b*. Serration set screws 113*a*, 113*b* oppose each other at approximately 180 degrees along cylinder 101. Inner ratcheting ring 113 is preferably approximately three inches in width parallel to the long axis of cylinder 101, and approximately twelve and one-half inches in outer circumference. Inner ratcheting ring 113 has a proximal ring edge 113*c* and a distal ring edge 113*d*, both of which are beveled.

Figure 11:
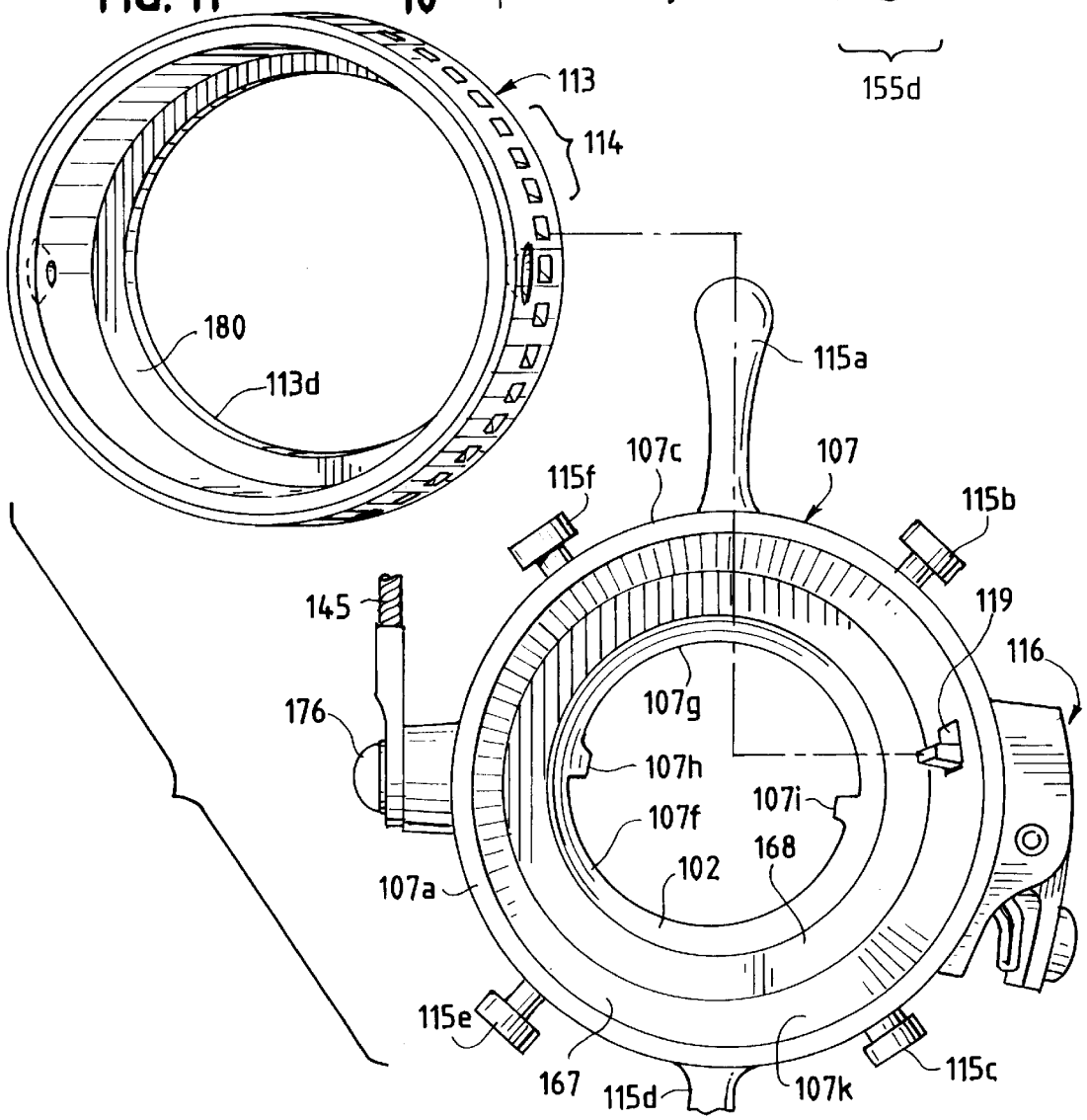
FIG. 11: Isolated partial anterior view of inner serrated ring with closeup cross-sectional view of outer ratcheting collar.

Inner ratcheting ring 113 is preferably approximately ¼ inch in thickness at distal ring edge 113*d* and proximal ring edge 113*c*. Referring to FIG. 11, inner ratcheting ring 113 also comprises a circular metal lip 180 at beveled distal ring edge 113*d*. Circular metal lip 180 is continuous with beveled distal ring edge 113*d*, and lip 180 is approximately perpendicular thereto. Circular metal lip 180 fits over cylinder distal end 104*b* and prevents inner ratcheting ring 113 from sliding along cylinder 101(in addition to opposing serration set screws 113*a*, 113*b*).

Circular metal lip 180 is approximately one-half inch wide, approximately one-half inch in thickness, and approximately three inches in inner diameter in the preferred embodiment. However, other dimensions of circular metal lip 180 are within the scope of my invention.

Referring initially to FIGS. 7 and 11 of the preferred embodiment, along the approximate midline circumference 113*e* of inner ratcheting ring 113 are a plurality of linearly aligned serrations 114*a*, 114*b*, 114*c*, etc. (generically serrations 114). When seen in upper plan view (FIG. 12), the edges of serrations 114 preferably form four-sided polygons. Preferably, each serration 114 in upper plan view comprises an upper longitudinal side 161*a* and a lower longitudinal side 161*b*. Longitudinal sides 161*a*, 161*b* of a single serration 114 are approximately parallel to the two longitudinal sides 161*a*, 161*b* of each adjoining serration 114. Longitudinal sides 161*a*, 161*b* of each serration 114 are aligned approximately perpendicular to midline circumference 113*e*, as best seen in FIG. 7.

Figure 12:
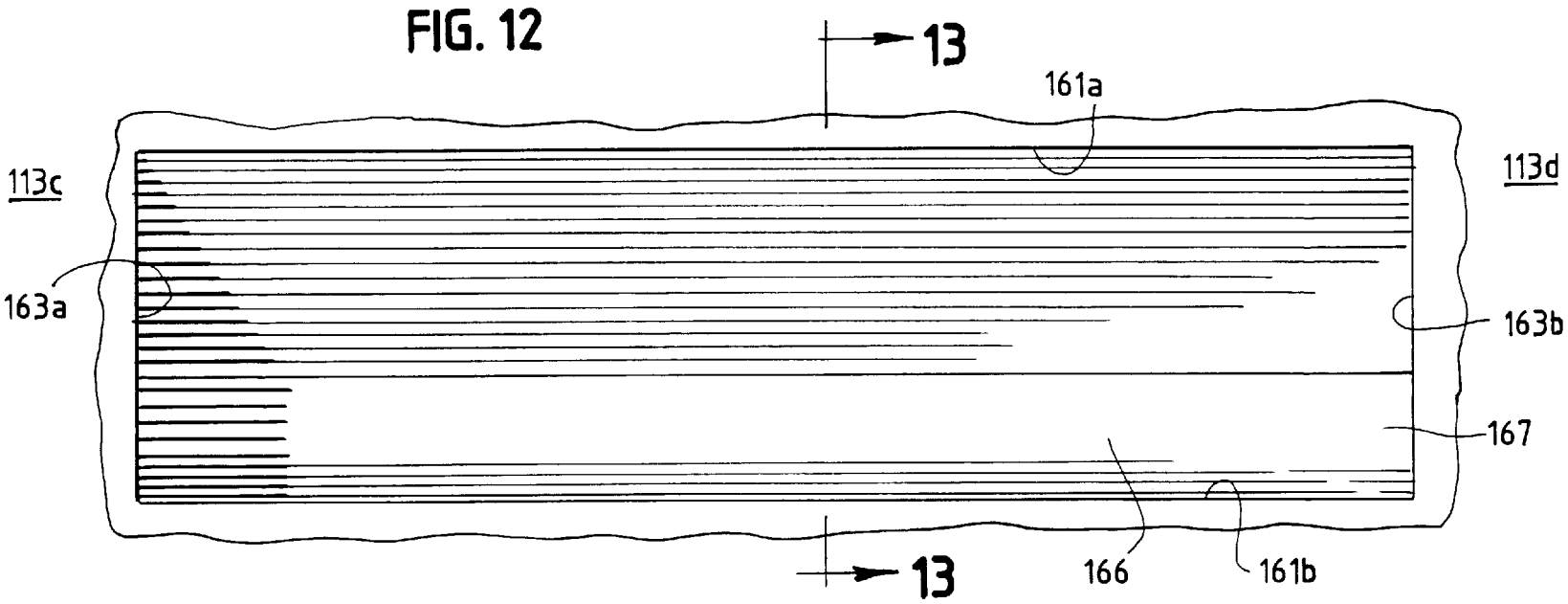
FIG. 12: Isolated upper plan view of a single serration within inner ratcheting ring.

Referring to FIG. 12, each serration 114 has a shorter proximal width side 163*a* and a distal width side 163*b*. Each width side 163*a*, 163*b* is approximately parallel to midline circumference 113*e*, and each width side 163*a*, 163*b* is shorter than either longitudinal length 161*a*, 161*b*. Each upper longitudinal side 161*a* of each serration 114 diverges toward distal serrated ring edge 113*d* approximately ten degrees.

Figure 13:
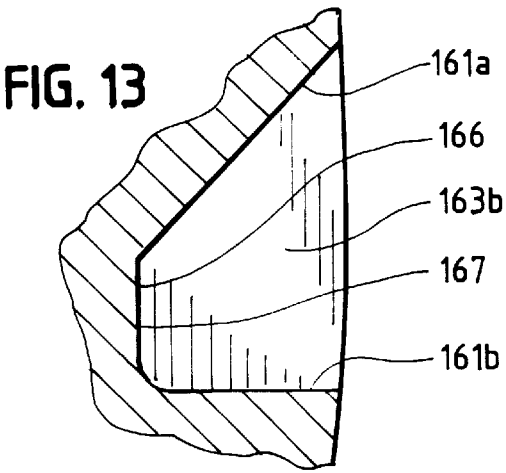
FIG. 13: Cross-sectional view of FIG. 12 taken through view line 13—13.

Also seen in FIG. 12 is narrow longitudinal base 166 of each serration 114. As best seen in FIG. 13 in cross-sectional view, each narrow longitudinal base 166 slopes from upper longitudinal side 161*a* to a maximum longitudinal depth 167. Each maximum longitudinal depth 167 is perpendicular to midline circumference 113*e*.

Maximum longitudinal depth 167 is positioned more proximal to lower longitudinal side 161*b*. Please see FIG. 13. In the preferred embodiment, each serration 114 is approximately:

(i) One-quarter inch in maximum longitudinal depth 167;

(ii) One-quarter inch wide at distal width end 163*a*; and (iii) ⅞ inch in length along upper longitudinal side 161*a*, and ¾ inch along lower longitudinal side 161*b*.

Each maximum longitudinal depth 167 is also approximately parallel to each maximum longitudinal depth 167 of adjoining serrations 114. Each serration 114 is separated from adjoining serrations 114 by approximately three-eighths (⅜) inch at each proximal width side 163*a*, and approximately one-eighth (⅛) inch at distal width side 163*b*. In the preferred embodiment there are 37 (thirty-seven) rectangular serrations along midline circumference 113*e*. However, other numbers, sizes and shapes, and depths of serrations are also within the scope of my invention.

Outer Ratcheting Collar 107

Referring initially to FIG. 2 of the preferred embodiment, outer ratcheting collar 107 can move axially from piston distal end 102*b* to cylinder distal end 104*b*. As seen in FIGS. 3 and 5 of the preferred embodiment, after assembly outer ratcheting collar 107 completely encloses inner ratcheting ring 113.

Outer ratcheting collar wall 107*c* is preferably approximately one-quarter (¼) inch in thickness and approximately four and one-quarter (4 and ¼) inches at its greatest axial width. In the preferred embodiment, outer ratcheting collar 107 has an outer diameter of approximately 13 inches. Outer ratcheting collar 107 is approximately four inches wide at its narrowest outer width.

Referring now to FIGS. 6 and 7 of the preferred embodiment, outer ratcheting collar 107 comprises a plurality of handles 115*a*, 115*b*, 115*c*, etc. (generically handles 115). Handles 115 are integral oblong components of outer ratcheting collar 107, and preferably are of two types:

(i) approximately four and one-quarter (4 and ¼) inches in axial and ⅓(one third) inch in height (115*b* length (115*b*, 115*c*, 115*e*, 115*f*); and (ii) approximately four and one-quarter (4 and ¼) inches in length and one and three quarters (1 and ¾) inches in height (115*a*, 115*d*).

In the preferred embodiment, there are six handles; four of which are the shorter height handle 115. However, other heights, shapes, lengths, numbers and types of handles are also within the scope of my invention.

Referring to FIG. 7, handles 115 are aligned parallel to each other and approximately perpendicular to the midline circumference 108 of outer ratcheting collar 107. Preferably, approximately 3 and ½ inches separate adjoining handles 15*b*, 115*c*, while approximately 3 and ½ inches separate adjoining handles 115*e* and 115*f*. Outer ratcheting collar 107 also comprises a threaded vertical screw 176, by which metal camming pin 170 is tethered to outer ratcheting collar 107 by steel lanyard 145.

As best seen in FIGS. 6 and 7 of the preferred embodiment, proximal outer ratcheting collar edge 107*a* is uniformly round and smooth. Proximal outer ratcheting collar edge 107*a* is preferably approximately one quarter (¼) inch in uniform thickness. Distal ratcheting collar edge 107*b* comprises 180 degree-opposing vertical first and second stopfaces 107*f*, 107*g* respectively. Continuous with stopfaces 107*f*, 107*g* are corresponding first and second sloping camming edges 107*h*, 107*i* respectively. Sloping camming edges 107*h*, 107*i* form camming surfaces for an abutting metal camming pin 170, infra.

Referring now to FIGS. 7 and 11 of the preferred embodiment, outer ratcheting collar 107 comprises inner collar surface 107*k*. Inner collar surface 107*k* comprises wider circular proximal step 167 and narrow circular distal step 168. Each step 167, 168 is axially aligned along cylinder 101, so distal narrower step 168 is nearest distal piston end 102*b* in assembled shoring device 100. Wider proximal step 167 comprises a wider inner diameter. This wider diameter allows outer ratcheting collar 107 to slide over (i) piston 102, and then (ii) inner ratcheting ring 113 until circular metal lip 180 engages narrower distal step 168.

Wider circular proximal step 167 is approximately four inches in interior diameter and approximately preferably 2.8 inches in interior axial length. Circular distal narrower step 168 is preferably approximately three inches in interior diameter and approximately 2.5 inches in interior axial length. Without narrow circular distal step 168, outer ratcheting collar 107 could slide along cylinder 102 prior to adjustment with locking rectangular protrusion 119, infra.

As best seen in FIGS. 7 and 8, between first and second short handles 115*b*, 115*c* respectively is collar lock member 116. Collar lock member 116 comprises a spring 125*a* biased rectangular protrusion 119, which completely penetrates outer ratcheting collar wall 107*c*. Rectangular protrusion 119 attaches to mechanical thumblock 126 by rotating hinge/roll pin 125. When there is no downward force on thumblock 126, rotating hinge 125 and spring 125*a* maintain rectangular protrusion 119 in an extended position from inner collar wall 107*k*. Rectangular projection 119 now interlocks with an appropriately positioned serration 114.

This engagement or interlocking can occur with each serration 114, but preferably only one at a time. This universal ratcheting effect occurs, because rectangular protrusion 119 is always congruently aligned over serrations 114 whenever outer ratcheting collar 107 is concentrically positioned over inner ratcheting ring 113. Please see FIG. 5. To attain congruency, proximal edge of rectangular protrusion 119 is positioned approximately one inch and one-sixteenth (1 and 1/16) inch from proximal outer ratcheting collar edge 107*a*. Correspondingly, proximal width sides 163*a* of serrations 114 are approximately one and one-sixteenth (1 and 1/16) inches from proximal inner ratcheting ring edge 113*c*.

Interlocking of rectangular protrusion 119 and an appropriately positioned serration 114 immobilizes outer ratcheting collar 107 by mechanically attaching outer ratcheting collar 107 to inner ratcheting ring 113. With manual pressure upon mechanical thumblock 126, rectangular protrusion 119 retracts along rotating hinge/roll pin 125, and rectangular protrusion 119 disengages from interlocking serration 114. After disengagement, the operator can rotate outer ratcheting collar 107 or axially move it distally along piston 102. The operator must maintain manual pressure on mechanical thumblock 126 to rotate outer ratcheting collar 107 counterclockwise.

As seen in FIG. 8 of the preferred embodiment, there is only one properly positioned serration 114, which engages one single corresponding rectangular protrusion 117. One also sees sidewall 1255*b* of locking member 116 in section. In other embodiments of my shoring device 100 there can be more than one such interlocking serration 114 and more than one rectangular protrusion 119.

Assembly of One Shoring Device 100

Each shoring device 100 is assembled exterior to a trench or structure to be shored or propped. The operator initially bolts rubber piston endcup 156 to proximal piston end 102*a*, while cylinder circular endcup 155*b* is bolted to distal end 155*i* of cylinder plug 155. Cylinder plug 155 is then inserted into proximal end 104*a* of cylinder 101 and attached thereto with screws 160*a*, 160*b*. The operator then inserts piston 102 into distal end 104*b* of cylinder 101 until cylinder rubber endcup 155*b* abuts piston circular rubber endcup 156.

The operator now slides inner ratcheting ring 113 over cylinder 101 until circular metal lip 180 engages cylinder distal end 104*b*. The operator attaches inner-ratcheting ring 113 to cylinder 101 with two screws 113*a*, 113*b*, and then positions outer ratcheting collar 107 over inner ratcheting ring 113. During positioning of outer ratcheting collar 107, the operator keeps manual thumblock 126 depressed.

As the last assembly step, the operator inserts removable swivel endplate 103*a* into proximal cylinder end 104*a*, and inserts removable swivel endplate 103*b* into distal piston end 102*b*. The operator aligns first and second cylinder apertures 116*a*, 116*b* so they congruently align with proximal swivel sideplate apertures 103*c*, 103*d*. He or she then takes a proximal swivel sideplate detente pin 105*a* and inserts it through properly aligned sideplate apertures 103*c*, 103*d* and cylinder apertures 116*a*, 116*b*.

Swivel sideplate detente pin 105*a* now attaches proximal swivel sideplate 103*a* within cylindrical plug 155. The operator now inserts distal swivel sideplate detente pin 105*b* through congruently aligned opposing piston apertures 128/130 or 129/131 and second swivel sideplate apertures 141*a*, 141*b*. Distal swivel piston sideplate detente pin 105*b* now attaches removable distal swivel sideplate 103*b* to distal cylinder end 102*b*. Tethered camming metal pin 170 is preferably temporarily inserted through an empty piston aperture, to prevent dragging and dangling outside the shoring area.

Operating Shoring Device 100

As an initial matter, my improved shoring device should never be operated except under lawful conditions and at the site of the shoring operation, infra. Assuming these safety conditions are met, my improved shoring device 100 operates in an extended position in which pressurized air initially forces piston 102 laterally from cylinder 100 in trench applications. Other applications such as vehicles and buildings require manual extension, as discussed supra.

To maintain this extended lateral piston position in pneumatic and non-pneumatic applications, the operator first manually rotates outer ratcheting collar 107 clockwise, until a specific aperture 128, 129, 130, 131 is closest to sloping camming surface 107*i* or 107*h*. Please see FIG. 7(129*a*/131*a*).

He then inserts tethered metal camming pin 170 within that closest piston aperture and through its 180-degree opposing piston aperture. For example, if the operator inserts camming metal pin 170 through piston aperture 128*b*, then straight camming metal pin 170 also inserts within opposing piston aperture 130*b*. The operator continues to rotate outer ratcheting collar 107 clockwise until metal camming pin 170 firmly abuts the closest sloping camming surface 107*i* or 107*j*, as the case may be.

After abutment, the operator obtains a maximum tight fit by continuing to rotate outer ratcheting collar 107 clockwise until rectangular protrusion 119 engages a serration 114 (as evidenced by a clicking sound).

Without additional pressurized air flowing to my shoring device 100 cylinder 101 and piston 102 remain laterally extended, because outer ratcheting collar 107 and inner ratcheting ring 113 prevent counter-clockwise rotational piston movement and subsequent slippage from cylinder 101. To disengage outer ratcheting collar 107 the operator rotates outer ratcheting collar 107 in a counter-clockwise direction while manually depressing mechanical thumblock 126. At this point, locking rectangular protrusion 119 disengages from engaged serration 114. He continues to rotate outer ratcheting collar 107 until metal camming pin 170 no longer abuts either sloping camming surface 107*i*, 107*j*. The operator then removes metal camming pin 170.

To rotate outer ratcheting collar 107 counterclockwise, the operator must keep manual pressure on thumblock 126. This manual pressure maintains rectangular protrusion 119 in a retracted position relative to serrations 114. Vent holes 112 within cylinder wall 101*d*, release gas from cylinder 101 whenever piston 102 extends from cylinder 101 sufficiently for piston rubber endcup 156 to pass beyond vent holes 112. As a result of vent holes 112, no further extension of shoring device 100 occurs, because the air pressure dissipates. The preferred number of vent holes 112 is four, but other numbers are also satisfactory.

Installation of Multiple Shoring Devices 100 in an Excavation or Trench

The operator always installs a plurality of my improved shoring devices 100 in progression from the top of the trench to the bottom of the trench. For horizontal and vertical placement requirements of trench supports for pneumatic shoring devices 100, please see attached Exhibits A and B. The best mode installation and removal procedure proceeds as follows:

1. The operator initially determines appropriate shoring configurations according to 29 C.F.R. 1926.652(Federal Register, Vol. 54(209): 45961–62, Oct. 31, 1989) (Requirements for protective systems). Under this regulation, the engineer's data in Exhibits A and B determines whether wooden boards, wooden boards with posterior plywood sheets, or aluminum wale-plates are necessary in a specific shoring operation.

For example:

(a) The installer can position a wooden board which is approximately 2 inches thick by 10 inches wide (designated as an "upright" in this industry) on each opposing trench wall surface. The operator can force these boards further into each trench wall using pressurized air, infra. Please see FIG. 1. The length of these boards varies, depending upon the dimensions of a trench or other application.

(b) In other circumstances, the operator can position an approximately 12-inch tall aluminum wale-plate at each end of shoring device 100. These wale-plates are approximately six inches wide and approximately 2 and ½ inch in thickness, and they eliminate the need for upright wooden boards.

(c) The operator then selects the proper size and number of shoring devices 100 needed to shore or prop the trench effectively. The installer positions plywood, timber uprights or aluminum wale-plates as required after he has descended into the trench, infra. FIG. 1 illustrates a plurality of shoring devices 100 in a trench, and in which shoring devices 100 support first and second wooden shoring boards and/or aluminum wale-plates.

2. The operator next determines that outer ratcheting collar 107 is properly positioned over inner ratcheting ring 113. Prior to installation, the installer will often place tethered camming metal pin 170 into one piston aperture 128, 129, 130, 131 to prevent camming metal pin 170 from dangling. However, the installer must remove tethered camming metal pin 170 prior to pressurizing shoring device 100, or pin 170 will prevent full extension of piston 102.

(a) The installation pressure is the air pressure required to expand piston 102 laterally from cylinder 101, thus forcing the upright wooden boards and/or aluminum wale-plates into opposing trench walls with attached swivel sideplates 103*a*, 103*b*. The preferred embodiment of my shoring device 100 requires an installation pressure of approximately 115 to 225 pounds per square inch in the best mode.

(b) Under this compressed gas or air pressure, piston 102 extends laterally and distally until both removable swivel sideplates both 103*a*, 103*b* bear against the wooden shoring boards and/or or wale-plates. First set screw 120*a* and second set screw 120*b* quickly engage the wooden shoring boards or aluminum wale-plates after introduction of pressurized air, thus preventing board or wale-plate random movement (c) In the best mode, there are at least two shoring devices in one trench whenever shoring devices 100 are the sole protection from wall collapse. For trenches with a depth greater than eight feet, in the best mode there should be a shored length of trench at least equal to its depth. For example, a trench that is twenty feet long and nine feet deep should have at least nine feet of its length shored, or propped, by my shoring device 100.

3. The operator next places a ladder in the trench and descends until his waist is even with the top of the trench. Third persons outside the trench assist by lowering the shoring device 100 to the descended operator with either a rope or webbing.

The installer now positions shoring device 100 to the required or desired depth(i.e., no deeper than two feet for the uppermost initial placement, and then no greater than four feet thereafter) within the trench, but he himself does not descend into the trench below his waist. The installer levels shoring device 100 to the horizontal (i.e., parallel to the floor of the trench) and authorizes air pressure to shoring device 100 from third persons. This air pressure results in immediate lateral extension of piston 102 within cylinder 101.

4. Vent holes 112 give an audible indication whenever piston 102, which must remain within cylinder 101, reaches its maximum extended position. This indication occurs whenever approximately ⅓ of piston 102 remains within cylinder 101 At this time, if additional shoring device 100 length is required, then the operator obtains a shoring device with a greater lateral extension.

(a) With piston 102 now fully extended from applied air pressure, the operator rotates outer ratcheting collar 107 clockwise, until a piston aperture 128, 129, 130, or 131 is closest to a sloping camming surface 107*i*, 107.

(b) He then inserts a metal camming pin 170 through this piston aperture and its 180-degree opposing counterpart, such as 128*c*/130*c*, 129*b*/131*b*, as examples. The operator continues to rotate outer ratcheting collar 107 until camming metal pin 170 firmly abuts either sloping camming surfaces 107*i* or 107*j*.

5. Immediately after metal camming pin 170 engages either sloping camming surface 107*i*, 107*j*, the operator continues to rotate outer ratcheting collar 107 until rectangular protrusion 119 engages a serration 114. This engagement prevents piston 102 from rotating counter-clockwise and retracting into cylinder 101.

(a) This result occurs because mechanically engaged inner ratcheting collar 107 and inner ratcheting ring 113 are (i) tightly locked to each other and (ii) tightly locked against piston 102 and cylinder 101.

(b) This tightly locked combination also presses stopfaces 107*i*, 107*j* and camming surfaces 107*f* and 107*g* directly against piston 102.

Inner ratcheting ring 113 also grasps piston 102 directly and is braced against counterclockwise rotational force by screws, which connect inner ratcheting ring 113 to cylinder 101. Please see FIG. 3. In addition, camming metal pin 170 prevents piston 102 from retracting into cylinder 101 or collapsing onto the trench floor.

6. Once outer ratcheting collar 107 and inner ratcheting ring 113 engage, the operator signals third persons to remove exterior air pressure from the now extended shoring device 100. The air hose is then removed from the leveled shoring device 100 to attach to another shoring device 100. This particular shoring device 100 is now in its extended longitudinal position, and its removable swivel sideplates 103*a*, 103*b* engage opposing wood shoring boards and/or aluminum wale-plates with setscrews 120.

7. Now that the first shoring device is installed, the installer can further descend the ladder within the trench, until his waist is even with the level of this initial installed shoring device 100. He then prepares to install a second shoring device 100 deeper within the trench. As the operator progresses deeper into the trench, his next "level of protection" is waist height with the last installed shoring device 100.

In the best mode of applying improved shoring device 100, the operator uses two-inch by ten-inch Douglas fir timber uprights or aluminum 12-inch wale-plates. Aluminum wale-plates are positioned horizontally or vertically. Plywood, timber uprights, and 12-inch wale-plates are all satisfactory, as long as these items continuously contact trench walls with no gaps or voids. Plywood sheeting is required in all trenches, regardless of depth, if the operator observes sloughing or raveling (movement of soil around or between shoring elements).

In the best mode and preferred embodiment, shoring device 100 is strongest whenever the operator positions it completely horizontally within the trench. However, other embodiments support structures for which a shoring device 100 is most effective when positioned vertically. With these embodiments, baseplates in place of swivel sideplates 103*a*, 103*b* are necessary for vertical positions. For example, with a single or a plurality of shoring devices 100, a vertical position (or small angle from the vertical) from the supporting flat surface is recommended for shoring of a vehicle or structure such as a house. In the preferred embodiment shoring device 100 is installed at an angle which deviates from the horizontal no more than 15 degrees.

Depending upon the circumstances, the engineer may require plywood in addition to either wooden upright boards or wale-plates. Where plywood is necessary, it is preferably 1 and ⅛ inch Douglas fir or 14-ply white birch. Douglas fir is a tree species, while a "number 2" designation refers to the wood quality and grade. These particular designations are well known in the rescue industry, as well as the lumber industry. The plywood must be at a minimum: 1 and ⅛ inch thick, approximately four feet wide and approximately eight feet long.

Alternatively, the installer can use the 14-ply (fourteen layers glued or laminated together) white birch plywood, which is approximately ¾ inch thick, four feet wide and eight feet in length. Other dimensions are also within the scope of my invention, as the operator is not limited to a certain plywood size.

Removal of Multiple Shoring Devices 100 within an Excavation or Trench

In a reverse chronology of the installation described immediately supra, the operator always removes a plurality of shoring devices 100 from the trench bottom to the upper trench edge. In this manner, the operator remains waist high to the last extended installed shoring device 100 within a trench. An operator at this "level of protection" is either completely exterior to the trench or at the level of the next highest fully installed shoring device 100. In the proper level, the operator next follows these steps:

1. Prior to disengagement and removal of each shoring device 100, air pressure is re-introduced through gas inlet 111 by a method well known in this particular industry. After re-introduction of air pressure, the operator depresses thumblock 126 and then rotates outer ratcheting collar 107 counter-clockwise to disengage rectangular locking protrusion 119 from serration 114. Each shoring device 100 requires the same pressure upon removal from the trench, as it did when it was originally installed.

2. He then continues counter-clockwise rotation of outer ratcheting collar 107 until metal camming pin 170 no longer abuts either sloping camming surface 107*i* or 107*j*. He then removes metal camming pin 170 from the appropriate piston apertures. The operator must remove metal camming pin 170 to retract shoring device 100.

(a) Shoring device 100 does not collapse at this point, because the air pressure provides continuing extension of piston 102. Without the continuing air pressure to this now pinless shoring device 100 the trench wall could collapse.

(b) With the air pressure still connected to gas inlet 111, the operator now ascends the ladder to either remove another shoring device 100, or exit the trench. After the operator is in a safe position, the air pressure through gas inlet 111 is removed, and third persons assist in lifting this particular shoring device 100 from the trench with rope or a webbing material.

Wherever possible, back filling replaces soil which was removed from a trench prior to the above-described operation. In the best mode of using my device 100, back filling is recommended after all shoring devices 100 are removed from the trench, and after the trench operation is complete. In the best mode, for trenches with a depth greater than eight feet, the length of the trench shored should equal the actual trench depth. Back filling can also be by concrete or wooden blocks. Backfilling should occur as each shoring device 100 is removed.

Operators should not use my shoring device 100 in trenches, which are wider than 15 feet or at a depth other than five to twenty feet. For depths greater than twenty feet, a registered engineer should be consulted for the appropriate wood or wale-plate shoring requirements.

Materials Comprising Shoring Device 100

The strength of the materials used in my components of my improved shoring device 100 is crucial to the physical characteristics of its structure and design:

(1) The preferred metal pins are available from:

PivotPoint

P.O. Box 488

Hustisford, Wis. 53034

The pin comprising rotating hinge 125 is straight and round, and is in effect a round roll pin.

Camming metal pins 170 have round "key rings" at the upper end of each pin to prevent slippage through piston 102. The recommended models are:

(a) ⅝ inch by 3.5-inch detente ring pins 105*c* with a collar (12L14Carbon Steel Zinc w/yellow chromate finish or stainless steel), where ⅝ inch is the diameter of the pin shaft;

(b) ⅝ inch by four and ¾ inch ring pin with collars (Grade 5, 1144 carbon steel with zinc and yellow chromate finish); and (c) 5/32×1 and ¼ inch, 4-20 stainless steel slotted spring pin.

Detente pins 105*a*, 105*b* with small detente beads 45 (See FIG. 3), are preferably made of carbon steel or stainless steel.

(2) Aluminum sand casted components such as inner ratcheting ring 113, outer ratcheting collar 107, cylinder plug 155 and swivel sideplates 103*a*, 103*b* are custom made by:

Louis Meskan Foundry 2007-13 North Major Ave.

Chicago, Ill. 60639

These 356-T components are made by initially pouring molten metal into a mold and are designated in the industry as "sand castings."

(3) Aluminum extruded cylinders 101, pistons 102 and 12-inch aluminum wale-plates are custom made by:

Precision Extrusions

720 East Green Street

Bensenville, Ill. 60106

The preferred material for cylinder 101 is aluminum type 6061-T6, which is extruded, and the dipped in cold water during a process well known in this particular industry. The pistons 102 and wale-plates are also of the 6061-T6 variety.

(4) Circular rubber (55 durometer neoprene) endcups 155*b*, 156 are custom-made by:

Packing Seals, Inc.

3507 North Kenton Ave.

Chicago, Ill. 60641

(5) The polyvinylchloride coated stainless steel lanyard 145 which connects metal camming pin 170 to outer ratcheting collar 107 is available from:

Lexco Cable

2738 West Belmont Ave.

Chicago, Ill. 60618

Model: 3/32, 7×7 G.A.C. (galvanized aircraft cable) coated with 3/16 clear polyvinyl chloride (6) The double torsion spring 125*a* along rotating hinge/roll pin 125 is available from:

Micromatic Spring Co.

9325 King Street

Franklin Park, Ill. 60131

Model: 0.062 diameter 302 SS double torsion stainless steel spring

CONCLUSIONS

The above is a description of the preferred embodiment of my improved shoring device 100, as well as the best mode of its application. However, these skilled in the art may envision other possible variations within the invention's scope, by changing the dimensions and shapes of its components. Accordingly, since my invention is possible in other specific forms without departing from the spirit or essential characteristics thereof, the embodiments described herein are considered in all respects illustrative and not restrictive.

In sum, all changes, which come within the meaning and range of equivalency of the claims, are intended to be included therein. As such, this above discussion describes the preferred embodiment and, but in no way limits the scope of my invention.

I claim:

1. A shoring device, said shoring device comprising:

(A) a piston and a cylinder, said cylinder partially enclosing said piston, said piston and said cylinder each comprising an interior wall, said cylinder and said piston both having a longitudinal axis, said piston and said cylinder each comprising a distal end and a proximal end, said piston and said cylinder each comprising an exterior wall, (B) a separately operable mechanical device, said mechanical device positioned along said piston and said cylinder for retention of said piston against rotation of said piston during an expanded condition, wherein said separately operable mechanical device comprises in combination, (1) an outer ratcheting collar, said outer ratcheting collar comprising a lock member, said outer ratcheting collar movably positioned along the longitudinal axis of said piston, said outer ratcheting collar rotatably engaging said cylinder and piston, (2) an inner ratcheting ring, said inner ratcheting ring fixedly encircling said distal end of said cylinder, said inner ratcheting ring comprising interlocking components, whereby said outer ratcheting collar engages said inner ratcheting ring, whereby said piston is tightly prevented from retraction by said outer ratcheting collar and said inner ratcheting ring.

2. A shoring device as described in claim 1, wherein said outer ratcheting collar comprises a plurality of handles and said locking member comprises a locking rectangular protrusion, said inner ratcheting ring comprising a midline circumference comprising a plurality of serrations.

3. The shoring device as described as described in claim 2, wherein said serrations are in parallel linear alignment along approximately said midline circumference, one serration interlocking with said locking protrusion.

4. A shoring device as described in claim 3, wherein there is a camming element which abuts said outer ratcheting collar, said camming element thereby preventing rotation of said piston, said shoring device being pneumatically driven during longitudinal expansion.

* * * * *